US011618656B2

(12) United States Patent
Torghele et al.

(10) Patent No.: US 11,618,656 B2
(45) Date of Patent: Apr. 4, 2023

(54) MOBILE CRANE HAVING A SEPARABLE A FRAME

(71) Applicant: LIEBHERR-WERK NENZING GMBH, Nenzing (AT)

(72) Inventors: Richard Torghele, Nenzing (AT); Manuel Torghele, Nenzing (AT)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 16 days.

(21) Appl. No.: 17/382,197

(22) Filed: Jul. 21, 2021

(65) Prior Publication Data

US 2022/0024733 A1 Jan. 27, 2022

(30) Foreign Application Priority Data

Jul. 21, 2020 (DE) ..... 20 2020 104 192.4

(51) Int. Cl.
*B66C 23/82* (2006.01)
*B66C 23/36* (2006.01)

(52) U.S. Cl.
CPC ..... *B66C 23/828* (2013.01); *B66C 23/365* (2013.01); *B66C 2700/0342* (2013.01)

(58) Field of Classification Search
CPC ..... B66C 23/26; B66C 23/365; B66C 23/82
USPC ..... 212/175
See application file for complete search history.

(56) References Cited

U.S. PATENT DOCUMENTS 3,977,530 A * 8/1976 Helm ..... B66C 23/36 212/175
4,421,241 A * 12/1983 Wittman ..... B66C 23/82 212/262
4,582,205 A * 4/1986 Berger ..... B66C 13/52 212/175
2007/0256999 A1* 11/2007 Kurotsu ..... B66C 23/82 212/298
2010/0213155 A1* 8/2010 Hanahara ..... B66C 23/36 212/294
2017/0341914 A1* 11/2017 Matsui ..... B66C 23/82

FOREIGN PATENT DOCUMENTS

DE 202017000243 U1 4/2018
JP S5438056 A 3/1979
JP S6050695 U * 9/1985 ..... B66C 23/82
JP H0466197 U * 10/1992 ..... B66C 23/82

OTHER PUBLICATIONS

JPS6050695U Machine Translation. (Year: 1985).*
Japanese Patent Office, Office Action Issued in Application No. 2021-117071, dated Jun. 28, 2022, 9 pages.

* cited by examiner

*Primary Examiner* — Michael R Mansen
*Assistant Examiner* — Juan J Campos, Jr.
(74) *Attorney, Agent, or Firm* — McCoy Russell LLP

(57) ABSTRACT

The disclosure relates to a mobile crane, such as a crawler crane, comprising an undercarriage having a traveling gear, a superstructure rotatably supported about a vertical axle on the undercarriage, a boom connected in an articulated manner to the superstructure pivotable about a horizontal axle, an A frame connected to the boom via a guying means, and a retraction mechanism by means of which the A frame is pivotable. In accordance with the disclosure, the A frame is separable and comprises a pole connected in an articulated manner to the superstructure and a folding pole releasably connected to the pole.

18 Claims, 3 Drawing Sheets

MOBILE CRANE HAVING A SEPARABLE A FRAME

CROSS REFERENCE TO RELATED APPLICATION

The present application claims priority to German Patent Application No. 20 2020 104 192.4 filed on Jul. 21, 2020. The entire contents of the above-listed application is hereby incorporated by reference for all purposes.

TECHNICAL FIELD

The present disclosure relates to a mobile crane, such as a crawler crane, and to a separable A frame for said crane.

BACKGROUND AND SUMMARY

In many mobile cranes, for instance in crawler cranes, it is known to guy the main boom via a guying frame or A frame pivotably connected in an articulated manner to the superstructure and to pivot the unit of boom and A frame by means of a retraction mechanism.

FIG. 1 shows in a side view a crawler crane 1 known from the prior art having an undercarriage 2 with a crawler travel gear, a superstructure 3 rotatably supported thereon about a vertical axle and having an operator's cabin 4 arranged in the front region, having a superstructure ballast 6 arranged in the rear region, and a main boom 6 pivotably supported about a horizontal axle. A load suspension means or lifting hook 7 is connected via a hoist rope 8 to a hoist rope winch 9 supported at the superstructure 3. An A frame 10 connected to the main boom 6 via retention rods 12 is connected in an articulated manner to the superstructure 3 pivotable about a horizontal axle.

The retraction mechanism typically comprises a retraction winch 20 arranged at the superstructure 3 and having a retraction rope 21 that is guided over a roller or roller set 24 arranged at the end of the A frame and over a roller or roller set 22 arranged at the superstructure 3. The distance between the rollers or roller sets 22, 24 can be reduced/increased by retracting/letting out the retraction rope 21 by means of the retraction winch 20 and the A frame 10 and the boom 6 can thereby be pivoted.

The main boom 6 together with the A frame 10 and the retention rods 12 forms an adjustment unit that is actuated by the retraction winch rope drive. The free length of the hoist rope 8 can be changed by actuating the hoist rope winch 9 and lifting loads attached to the load hook 7 can thereby be raised or lowered. In some cranes, a derrick boom pivotably connected in an articulated manner at the superstructure 3 is provided in addition to the main boom 6, with the A frame 10 in this case not being connected to the main boom 6, but rather to the derrick boom via the retention rods 12.

The base unit of undercarriage and superstructure is typically transported to the deployment site without the crawler carrier and the superstructure ballast and together with the A frame and is assembled on site. The A frame's own weight here substantially contributes to the total weight of the transported unit, which may be problematic with respect to provisions on the maximum permitted transport weight during (road) transport—such as in countries having strict regulations in this respect. A removal of the total unit of A frame and retraction mechanism is also disadvantageous since the attachment and removal is comparatively complicated and time consuming and there is a risk of damage to sensitive components of the retraction mechanism on the attachment and removal or on transport.

Against this background, it is an underlying object of the present disclosure to provide a mobile crane having an A frame that has a transportable unit of the base device with reduced weight and small assembly effort.

This object is achieved in accordance with the disclosed crane having the features of the following description. A mobile crane, such as a crawler crane, comprises an undercarriage having a traveling gear, a superstructure rotatably supported about a vertical axle on the undercarriage, a boom connected in an articulated manner to the superstructure pivotable about a horizontal axle, an A frame connected in an articulated manner to the superstructure pivotable about a horizontal axle and connected to the boom via a guying means, and a retraction mechanism, with the A frame being pivotable by means of the retraction mechanism. In accordance with the disclosure, the A frame is designed as separable, i.e. dismantlable for transport, and comprises a pole pivotably connected in an articulated manner to the superstructure and a folding pole releasably connected to the pole.

Since the A frame can be dismantled into a pole and a folding pole in accordance with the disclosure, it is possible only to remove a part of the A frame, such as the pole, for transport and to leave the other part, such as the folding pole, on the superstructure together with the retraction mechanism. It is thus possible to disassemble the base unit typically disassembled for transport into an even smaller and lighter transport unit without likewise having to remove the retraction mechanism, which simplifies and accelerates the assembly procedure. In addition, sensitive and expensive components of the retraction mechanism are protected against handling and transport damage.

The part of the A frame removable for transport can be removed fast and simply, is compact, and therefore requires a small transport volume. Substantial transport advantages with respect to costs, permits from authorities, for instance in countries with strict regulations with respect to the maximum transport weight, result from the reduced transport weight of the disassembled base unit.

The term "folding pole" is to be given a wide interpretation and does not necessarily require that this part is designed as foldable. It can here be any desired part of the A frame that can remain on the superstructure after the removal of the pole. The boom and the A frame can be pivotable about the same axles or about different axles. The boom can be the main boom or a derrick boom.

Provision is made in an embodiment that the folding pole can be removed from the pole and can be releasably mounted to the superstructure. The pole is therefore removed for transport and is transported separately while the folding pole is reversibly fastened to the superstructure and is transported together with it.

Provision is made in a further embodiment that the components of the retraction mechanism fastened to the A frame are arranged at the folding pole. It is thereby possible to leave the part of the A frame connected to the retraction mechanism on the superstructure for transport and to remove and separately transport the remainder of the A frame, namely the pole. A fast and simple disassembly or assembly of the A frame thus results. The components of the retraction mechanism do not have to be removed from the structures bearing them.

Provision is made in a further embodiment that the retraction mechanism comprises a retraction winch arranged at the superstructure, a first roller set arranged on the superstructure, and a second roller set arranged on the folding pole. The retraction rope can be guided about the roller sets by multiple winding. The second roller set is, in certain embodiments, arranged at the outer end of the A frame. The folding pole can thereby be small and only comprise the structure of the A frame surrounding the second roller set and bearing it so that the majority of the A frame is removable in the form of the pole and the weight of the remaining transport unit can be considerably reduced.

Provision is made in a further embodiment that the folding pole forms the end of the A frame spaced apart from the articulated connection axle and may have connection means for fastening the guying means. The connection means can be located on the side (upper side) of the A frame facing the boom. They can here be pinning points for fastening retention rods.

Provision is made in a further embodiment that the pole can be removed from the superstructure and from the folding pole and can be transported separately, with the retraction mechanism remaining on the superstructure. The connection between the pole and the folding pole and the connection of the pole to the superstructure is released for this purpose.

Provision is made in a further embodiment that the folding pole and the superstructure each have fastening means by means of which the folding pole can be releasably mounted on the superstructure, with the fastening means of the superstructure being arranged in its rear region and the fastening means of the folding pole being arranged on the side (lower side) of the A frame remote from the boom. They can here be pinning points for establishing releasable pin connections. The folding pole only has to be downwardly pivoted or folded way about a horizontal axle to join the fastening means together in this advantageous arrangement and the joined together fastening means only subsequently have to be connected. The remaining connection to the pole can then be released and the latter can be removed from the superstructure. The pivoting of the folding pole can take place with the aid of an auxiliary crane.

Provision is made in a further embodiment that the folding pole is connected to the pole pivotable about an axle that is horizontal (pivot axle) and is latchable thereto, with this axle and the latching connection each being releasable pin connection. The latching connection can take place along an axle (latching axle) in parallel with the pivot axle. The pole and the folding pole can each have connection means, such as pinning points, for this purpose. The folding pole can be pivoted about the pivot axle relative to the pole by releasing the connection to the latching axle.

Provision is made in a further embodiment that the fastening means of the folding pole and superstructure can be joined together by pivoting the folding pole about the axle (pivot axle). The connection between the pole and the folding pole along the pivot axle can be released after the establishment of the connection of the fastening means. The pivoting of the folding pole can take place with the aid of an auxiliary crane.

Provision is made in a further embodiment that the pole is longer than the folding pole. The majority of the A frame can thereby be removed for transport and the weight of the transport unit can be considerably reduced. Provision can alternatively or additionally be made that the pole and the folding pole substantially have the same width. The A frame can, however, also have a base shape tapering toward the end. In this case, the pole and the folding pole at least substantially have the same width at the connection points.

Provision is made in a further embodiment that the A frame has a rack-like structure having two side members that are in particular in parallel and having at least one cross member that connects the side members, with at least one cross member being arranged at the folding pole. The side members can alternatively converge toward one another toward the folding pole.

Provision is made in a further embodiment that that guying means comprises one or more rigid guying rods each pivotably fastened to the boom and to the A frame.

The present disclosure furthermore relates to a separable A frame for a mobile crane in accordance with the disclosure. In this respect, the same advantages and properties obviously result as for the crane in accordance with the disclosure so that a repeat description will be dispensed with at this point.

BRIEF DESCRIPTION OF THE FIGURES

Further features, details, and advantages of the disclosure result from the embodiments explained in the following with reference to the Figures. There are shown.

DETAILED DESCRIPTION

Figure 1:
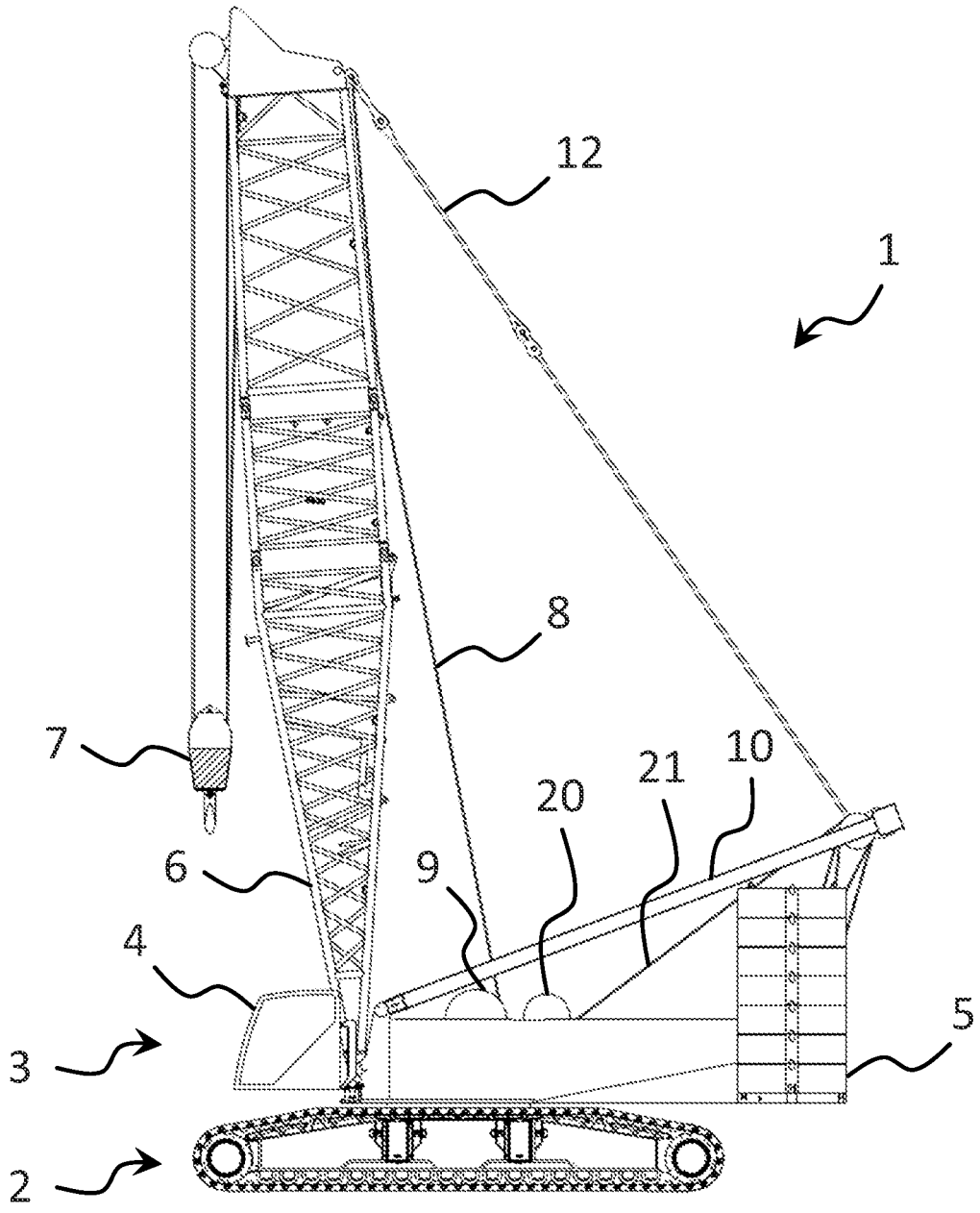
Fig. 1 (Prior Art)
FIG. 1: a crawler crane of the category having an A frame in a side view.

FIG. 1 shows a crawler crane 1 of the category having an A frame 10 in a side view and has already been initially described in detail. Repeat descriptions are therefore dispensed with. The mobile crane in accordance with the disclosure can be such a crawler crane 1, with the A frame 10 being separable in comparison with units of the category.

Figure 2:
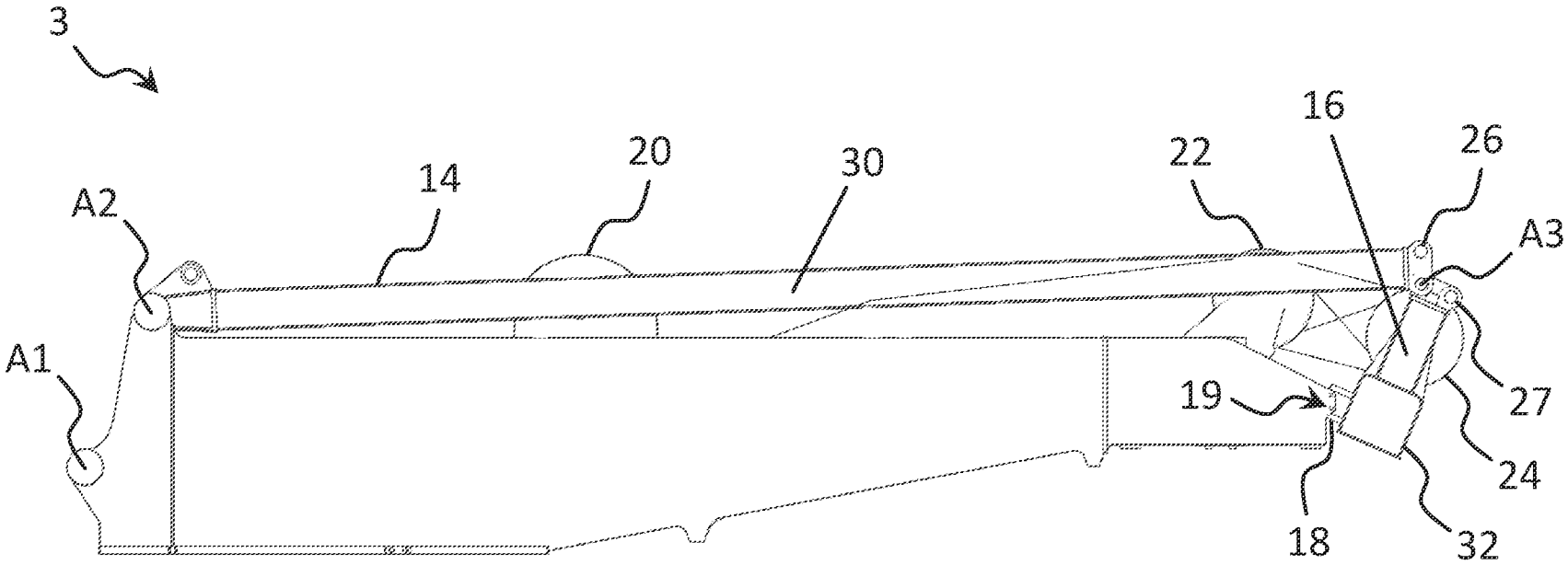
FIG. 2: the superstructure of an embodiment of the crane in accordance with the disclosure with a folded over folding pole in a schematic side view.

FIG. 2 shows in a side view a detail of the superstructure 3 in accordance with an embodiment of the crane 1 in accordance with the disclosure that is a crawler crane 1 in accordance with FIG. 1. In accordance with the disclosure, the A frame 10 is separable or dismantlable and comprises a pole 144 connected to the superstructure 3 pivotable about a horizontal axle A2 and a folding pole 16 that is releasably fastened thereto and that forms the end of the A frame 10 spaced apart from the axle A2. The boom 6, that is the main boom of the crane 1 in the present embodiment, is a horizontal axle A1 spaced apart from the axle A2.

The A frame 10 is adjustable or pivotable via an actuation of a retraction mechanism, with the retraction mechanism comprising a retraction winch 20 arranged on the superstructure 3, a first roller set 22 arranged at the rear end of the superstructure 3, and a second roller set 24 fastened to the folding pole 16. A retraction rope 21 that is supported in a windable and unwindable manner on the retraction winch 20 is guided or wound multiple times around the roller sets 22, 24 The distance between the roller sets 22, 24 can be reduced and the A frame can thereby be pivoted to the rear/downwardly by winding up the retraction rope 21. The reverse movement takes place on the unwinding due to the weight of the boom 6 coupled to the A frame 10 via the retention rods 12 in working operation. In one embodiment, the A frame 10 may have a rack-like structure having a first side member 30 and a second side member in parallel and having at least one cross member 32 being arranged at the folding pole.

The A frame 10 or the pole 14 and folding pole 16 can comprise two outer side members, with the second roller set 24 being supported between the outer side members of the folding pole 16. The pole 14 and the folding pole 16 each have connection means 26, 27 by which they are releasably connected or connectable to one another. The connection means 26, 27 are here designed as pinning points via which two parallel pin connections can be established. In some aspects, the folding pole forms the end of the A frame spaced apart from the articulated connection axle and may have connection means as shown by arrow 34 for fastening the guying means. The connection means can be located on the side (upper side) of the A frame facing the boom.

The A frame 10 is pivoted downwardly for the removal of the pole 14 from the superstructure 3 for the purpose of transport so that it substantially contacts the superstructure 3 (cf. FIG. 2). By releasing the upper one of the two pin connections (latching axle) between the pole 14 and the folding pole 16, the latter can be pivoted or folded downwardly in the direction of the superstructure 3 about the lower pin connection that forms a horizontal pivot axle A3. The pivoting of the folding pole 16 about the axle A3 can take place by means of an auxiliary crane. The second roller set 24 here moves slightly relative to the first roller set 22.

Fastening means 18 formed as pinning points are located at the side remote from the boom 6 or at the lower side of the folding pole 16. Such fastening means 19 are likewise arranged at the rear end or in the rear region of the superstructure 3. By pivoting the folding pole 16 about the axle A3, the former rotates with respect to the superstructure 3 and the fastening means 18, 19 are joined together, i.e. the pinning points are brought into alignment. The folding pole 16 is fastened to the superstructure 3 by pinning the fastening means 18, 19 so that the pin connection to the pole (axle A3) can now be released. It is conceivable here that the now released pins of the released upper pin connection (latching axle) between the pole 14 and the folding pole 16 can be used for the pin connection of the fastening means 18, 19. Separate pins can, however, also be used.

Once the folding pole 16 has been mounted on the superstructure 3 and the pin connection to the pole 14 has been released, the pole 14 can be dismantled from the superstructure 3. Since the pole 14 itself does not bear any component of the retraction mechanism, the latter remains completely at the superstructure 3 and can be transported together with it.

Figure 3:
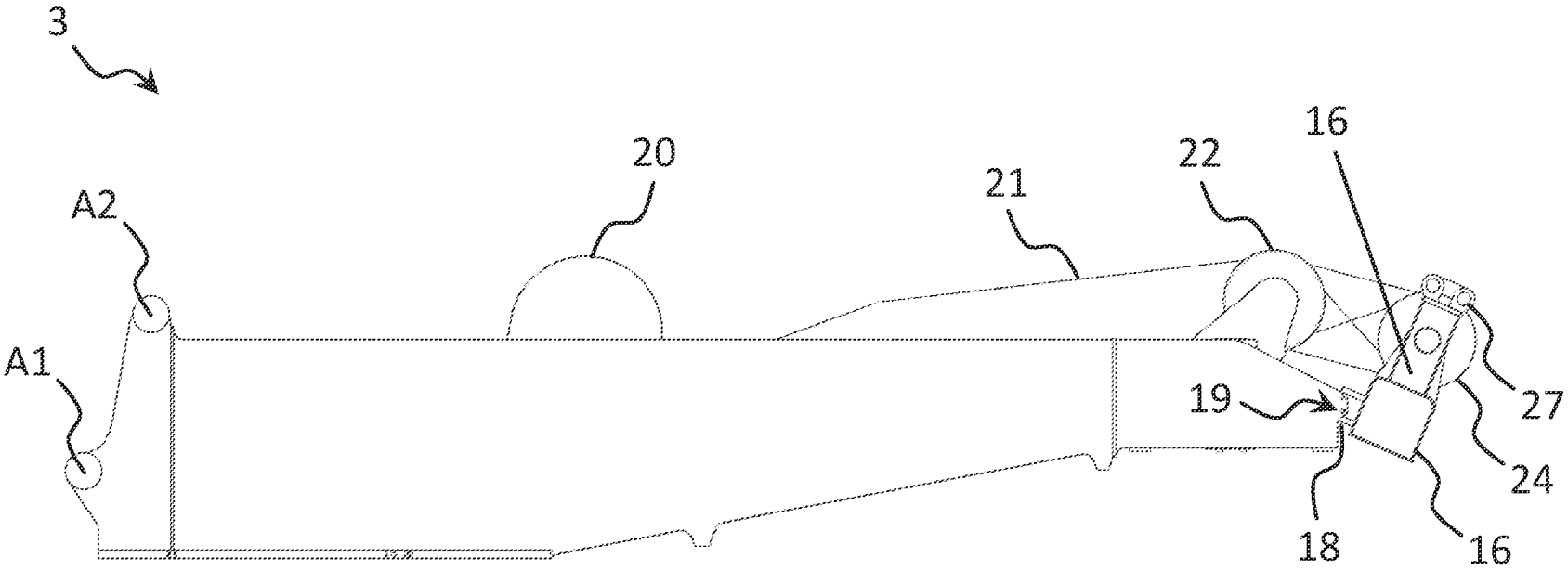
FIG. 3: the superstructure in accordance with FIG. 2 after removal of the pole.

FIG. 3 shows the superstructure 3 in the transport position after removal of the pole 14, with the folding pole 16 being supported at its rear. Since the pole 14 is substantially larger or longer than the folding pole 16 that only forms the tip of the A frame 10, the transport weight of the remaining unit can be considerably reduced by dismantling the pole 14. In some aspects, the pole and the folding pole may substantially have the same width. The A frame can, however, also have a base shape tapering toward the end. In this case, the pole and the folding pole at least substantially have the same width at the connection points as shown by 14 and 16 in FIG. 2. The removal itself can take place simply and fast since no complicated parts have to be dismantled. The removal is also simpler and more damage safe than the dismantling of the total A frame 10 including the retraction mechanism. The pole 14 itself is compact and therefore only requires a small transport volume.

A method of dismantling the pole 14 for the purpose of forming a light transport unit could comprise the following steps: lowering the A frame 10, releasing the guying means 12 from the A frame 10, releasing the upper (pin) connection between the pole 14 and the folding pole 16, pivoting the folding pole 16 about the lower pin connection A3, optionally by means of an auxiliary crane, connecting or pinning the fastening means 18, 19 of the folding pole 16 and the superstructure 3 that have been pivoted together, releasing the lower (pin) connection A3 between the pole 14 and the folding pole 16, removing the pole 14 (such as by releasing the connection at the axle A2 to the superstructure 3), optionally by means of an auxiliary crane. These steps are run through in reverse order for the assembly of the pole 14.

The A frame 10 in accordance with the disclosure can also simply be retrofitted to existing cranes 1. The fastening means 19 for fastening the folding pole 16 only have to be attached at the suitable point at the rear of the superstructure 3 for this purpose and the second roller set 24 has to be mounted on the folding pole 16.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

REFERENCE NUMERAL LIST

1 crane
2 undercarriage

3 superstructure
4 operator's cabin
5 superstructure ballast
6 boom (main boom)
7 load suspension means (load hook)
8 hoist rope
9 hoist rope winch
10 A frame
12 guying means (retention rods)
14 pole
16 folding pole
18 fastening means, folding pole
19 fastening means, superstructure
20 retraction winch
21 retraction rope
22 first roller set
24 second roller set
26 connection means, pole
27 fastening means, folding pole
A1 axle
A2 axle
A3 axle

The invention claimed is:

1. A mobile crane, comprising:

an undercarriage having a traveling gear;

a superstructure supported rotatably about a vertical axle on the undercarriage;

a boom connected in an articulated manner to the superstructure pivotable about a horizontal axle;

an A frame connected in an articulated manner to the superstructure pivotable about a horizontal axle and connected to the boom by means of a guying means; and a retraction mechanism by means of which the A frame is pivotable, wherein the A frame is separable and comprises a pole connected in an articulated manner to the superstructure and a folding pole releasably connected to the pole;

the folding pole can be removed from the pole and can be releasably mounted on the superstructure; and the folding pole and the superstructure each have fastening means by means of which the folding pole can be releasably mounted on the superstructure.

2. The mobile crane in accordance with claim 1, wherein components of the retraction mechanism fastened to the A frame are arranged at the folding pole.

3. The mobile crane in accordance with claim 2, wherein the retraction mechanism comprises a retraction winch arranged on the superstructure, a first roller set arranged on the superstructure, and a second roller set arranged on the folding pole.

4. The mobile crane in accordance with claim 1, wherein the folding pole forms an end of the A frame.

5. The mobile crane in accordance with claim 4, wherein the folding pole formed at the end of the A frame has a connection means for fastening the guying means.

6. The mobile crane in accordance with claim 1, wherein the pole can be removed from the superstructure and from the folding pole and can be transported separately, with the retraction mechanism remaining on the superstructure.

7. The mobile crane in accordance with claim 1, wherein the folding pole is connected to the pole pivotably about an axle that is horizontal and is latchable thereto.

8. The mobile crane in accordance with claim 7, wherein the axle and a latching connection have releasable pin connections.

9. The mobile crane in accordance with claim 1, wherein the folding pole is connected to the pole pivotably about an axle that is horizontal and is latchable thereto, and further wherein the fastening means of the folding pole and the superstructure can be joined together by pivoting the folding pole about the axle.

10. The mobile crane in accordance with claim 1, wherein the pole is longer than the folding pole.

11. The mobile crane in accordance with claim 1, wherein the A frame has a rack structure having two side members that are in parallel and having at least one cross member.

12. The mobile crane in accordance with claim 11, wherein the at least one cross member is arranged at the folding pole.

13. The mobile crane in accordance with claim 1, wherein the guying means comprises one or more rigid guying rods each pivotably fastened to the boom and to the A frame.

14. The mobile crane in accordance with claim 1, wherein the mobile crane is a crawler crane.

15. The mobile crane in accordance with claim 1, wherein the fastening means of the superstructure is arranged in a rear region of the superstructure.

16. The mobile crane in accordance with claim 1, wherein the fastening means of the folding pole are arranged on a side of the A frame remote from the boom.

17. The mobile crane in accordance with claim 1, wherein the pole and the folding pole substantially have the same width.

18. A separable A frame for a mobile crane comprising a pole connected in an articulated manner to a superstructure of the mobile crane and a folding pole releasably connected to the pole;

wherein the folding pole can be removed from the pole and can be releasably mounted on the superstructure; and wherein the folding pole and the superstructure each have fastening means by means of which the folding pole can be releasably mounted on the superstructure.

* * * * *